US007832669B2

(12) United States Patent
Vendelin

(10) Patent No.: US 7,832,669 B2
(45) Date of Patent: Nov. 16, 2010

(54) SCREW ADJUST CONE CRUSHER

(76) Inventor: John C. Vendelin, 1800 Hidden Hollow La. NW., Cedar Rapids, IA (US) 52405

( * ) Notice: Subject to any disclaimer, the term of this patent is extended or adjusted under 35 U.S.C. 154(b) by 146 days.

(21) Appl. No.: 12/333,101

(22) Filed: Dec. 11, 2008

(65) Prior Publication Data

US 2009/0152385 A1 Jun. 18, 2009

Related U.S. Application Data

(60) Provisional application No. 61/013,874, filed on Dec. 14, 2007.

(51) Int. Cl.
*B02C 2/00* (2006.01)

(52) U.S. Cl. ..... 241/207; 241/286

(58) Field of Classification Search ..... 241/207–216, 241/82, 286, 285.2

See application file for complete search history.

(56) References Cited

U.S. PATENT DOCUMENTS

| | | | | |
|---|---|---|---|---|
| 3,118,623 | A | | 1/1964 | Johnson |
| 3,337,143 | A | | 8/1967 | Johnson |
| 5,718,390 | A | | 2/1998 | Ganser, IV et al. |
| 5,875,981 | A | | 3/1999 | Ganser, IV et al. |
| 5,931,394 | A | * | 8/1999 | Haven et al. ..... 241/30 |
| 5,971,306 | A | * | 10/1999 | Ganser et al. ..... 241/207 |
| 5,996,916 | A | * | 12/1999 | Musil ..... 241/215 |

* cited by examiner

*Primary Examiner*—Mark Rosenbaum
(74) *Attorney, Agent, or Firm*—Simmons Perrine Moyer Bergman PLC

(57) ABSTRACT

A screw adjust cone crusher with a top tramp iron relief system where the bonnet can be vertically adjusted by rotating the threaded bonnet support within the threaded lower section. The tramp iron system is disposed entirely above the bonnet, thereby creating a small footprint screw adjust cone crusher with overhead tramp iron release system.

16 Claims, 9 Drawing Sheets

SCREW ADJUST CONE CRUSHER

CROSS REFERENCE TO RELATED APPLICATION

This application claims the benefit of the filing date of the provisional application having Ser. No. 61/013,874 filed on Dec. 14, 2007 by John Vendelin, which application is incorporated herein in its entirety by this reference.

FIELD OF THE INVENTION

The present invention generally relates to rock crushers, and more particularly to screw adjusting cone crushers.

BACKGROUND OF THE INVENTION

In the past, many rock crushing operations have used a shim adjusting cone crusher atop a trailer, together with a crushed rock capturing conveyor disposed below the crusher. Many of these systems have performed well in the past. However, the cone crusher in these systems has a limited life and must be occasionally replaced. Screw adjusting cone crushers have gained popularity in the industry for their quick material (output) close side setting adjustment capabilities. However, these screw adjusting cone crushers are often too large to function as a replacement on a trailer for a smaller shim adjust cone crusher.

Consequently, there exists a need for a screw adjust cone crusher with a limited footprint so as to allow for retro-fitting on to a trailer previously holding a shim adjust cone crusher.

SUMMARY OF THE INVENTION

It is an object of the present invention to provide rock crushing operations with a cost-effective quick material output size adjusting cone crusher.

It is a feature of the present invention to utilize a screw adjusting cone crusher with a tramp iron relief system disposed substantially entirely on top of the bonnet.

It is an advantage of the present invention to provide for the ability of a compact screw adjust cone crusher to replace a shim adjust cone crusher of the type having a footprint which is smaller than a typical footprint size for a screw adjust cone crusher.

The present invention is an apparatus and method for crushing rock which is designed to satisfy the aforementioned needs, provide the previously stated objects, include the above-listed features, and achieve the already articulated advantages. For some crushing operations, the present invention is carried out in a "trailer replacement-less system" in a sense that the need to replace a trailer and a conveyor system every time a mobile shim adjust cone crusher needs replacement, has been greatly reduced.

Accordingly, the present invention is a system and method for screw adjusting a cone crusher with a top tramp iron relief system.

BRIEF DESCRIPTION OF THE DRAWINGS

The invention may be more fully understood by reading the following description of the preferred embodiments of the invention, in conjunction with the appended drawings wherein:

FIG. 6 is a cross-sectional view of the tramp iron relief section taken on line G-G of FIG. 5.

FIG. 7 is an enlarged section of the cross-sectional view of FIG. 6.

DETAILED DESCRIPTION

Figure 1:
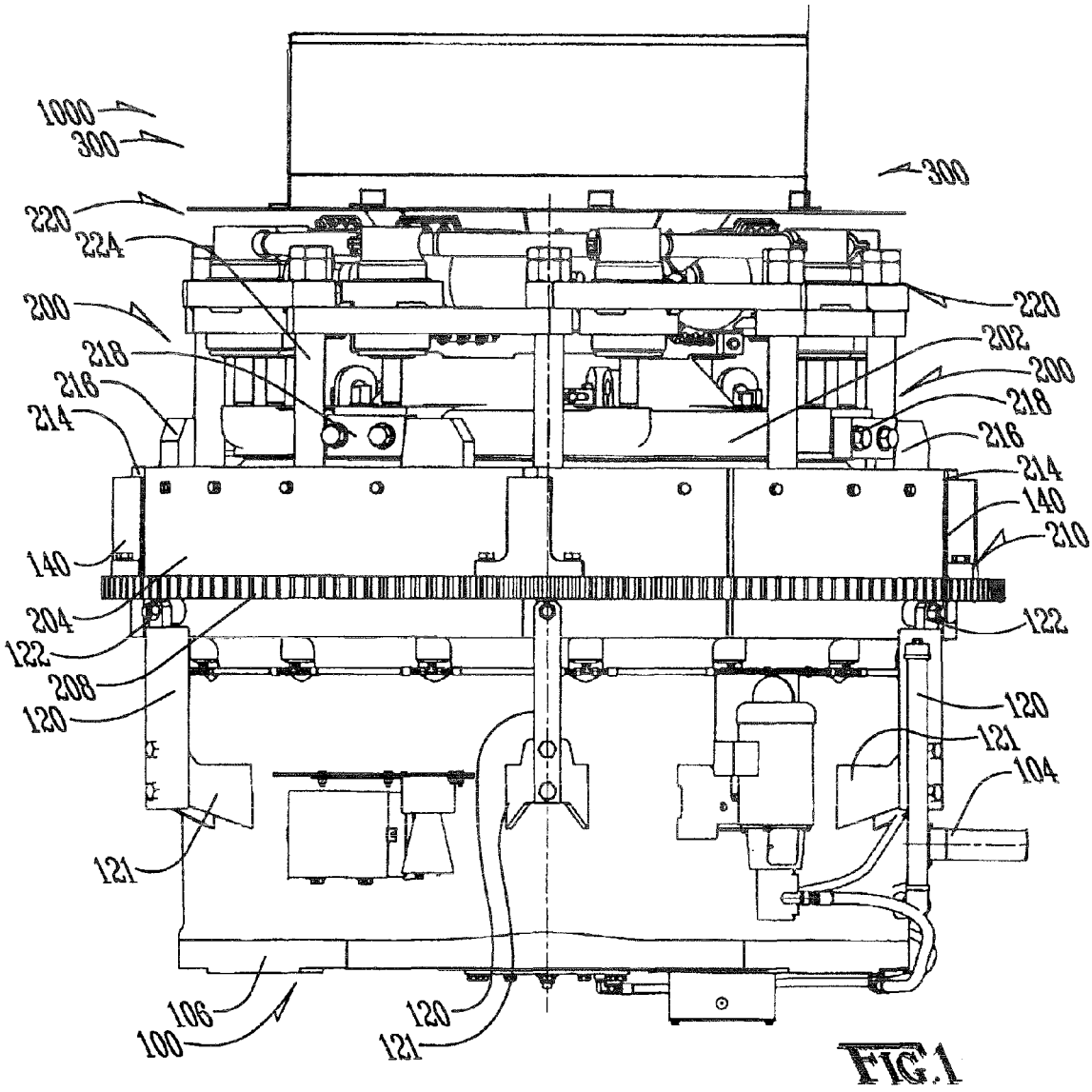
FIG. 1 is a side view of the cone crusher of the present invention.

Now referring to the drawings wherein like numerals refer to like matter throughout, and more particularly to FIG. 1, there is shown a screw adjust cone crusher with overhead tramp iron release system generally designated 1000, which in intended to be used in the rock crushing industry in a manner similar to other rock crushers which are manufactured and sold by the Terex Corporation. Screw adjust cone crusher with overhead tramp iron release system 1000 includes a lower section 100, an upper section 200 and an optional wire basket hopper 300.

Figure 2:
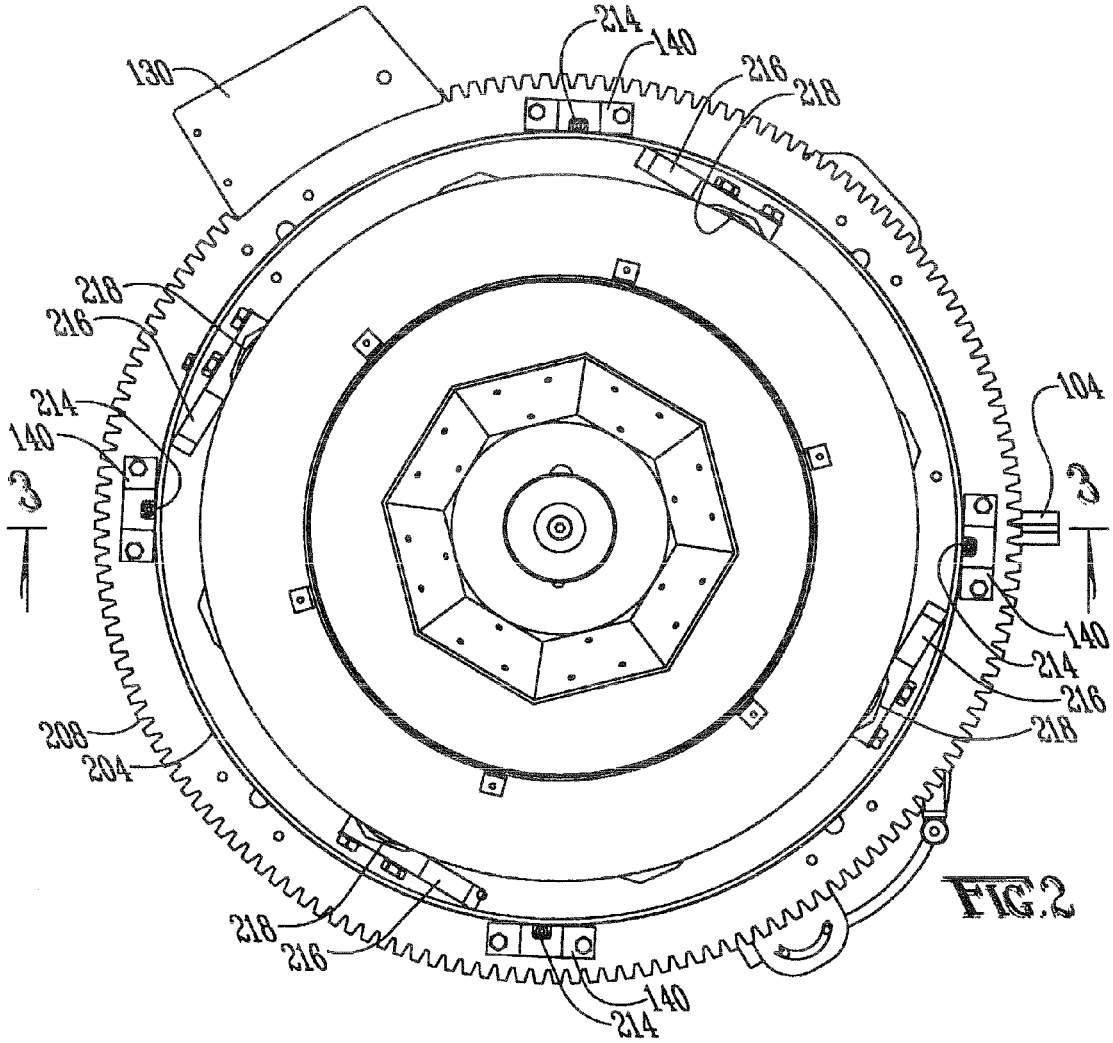
FIG. 2 is a top view of the cone crusher of FIG. 1.
Figure 3:
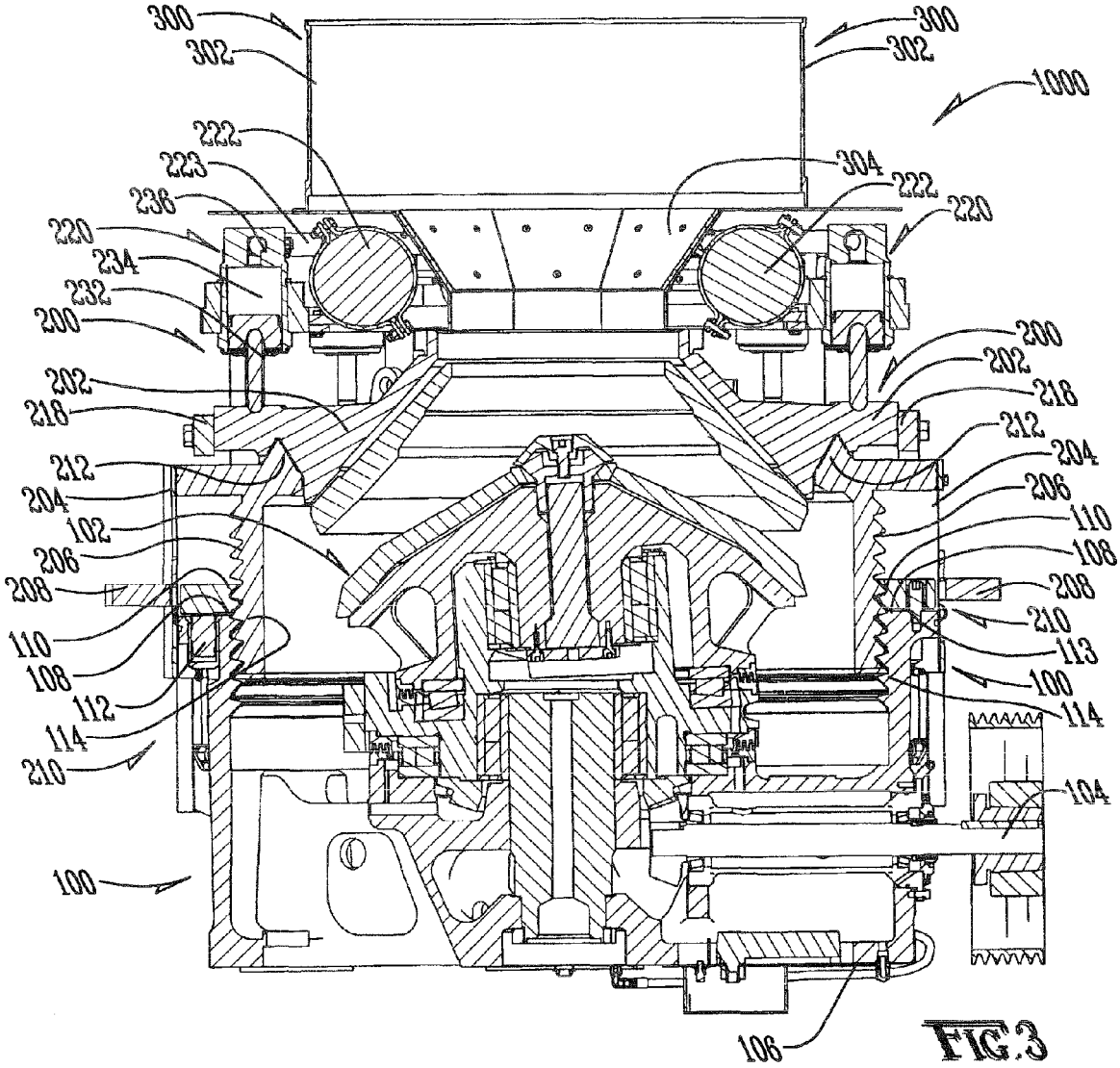
FIG. 3 is a cross-sectional view of the cone crusher of FIGS. 1 and 2 taken on line 3-3 of FIG. 2.
Figure 4:
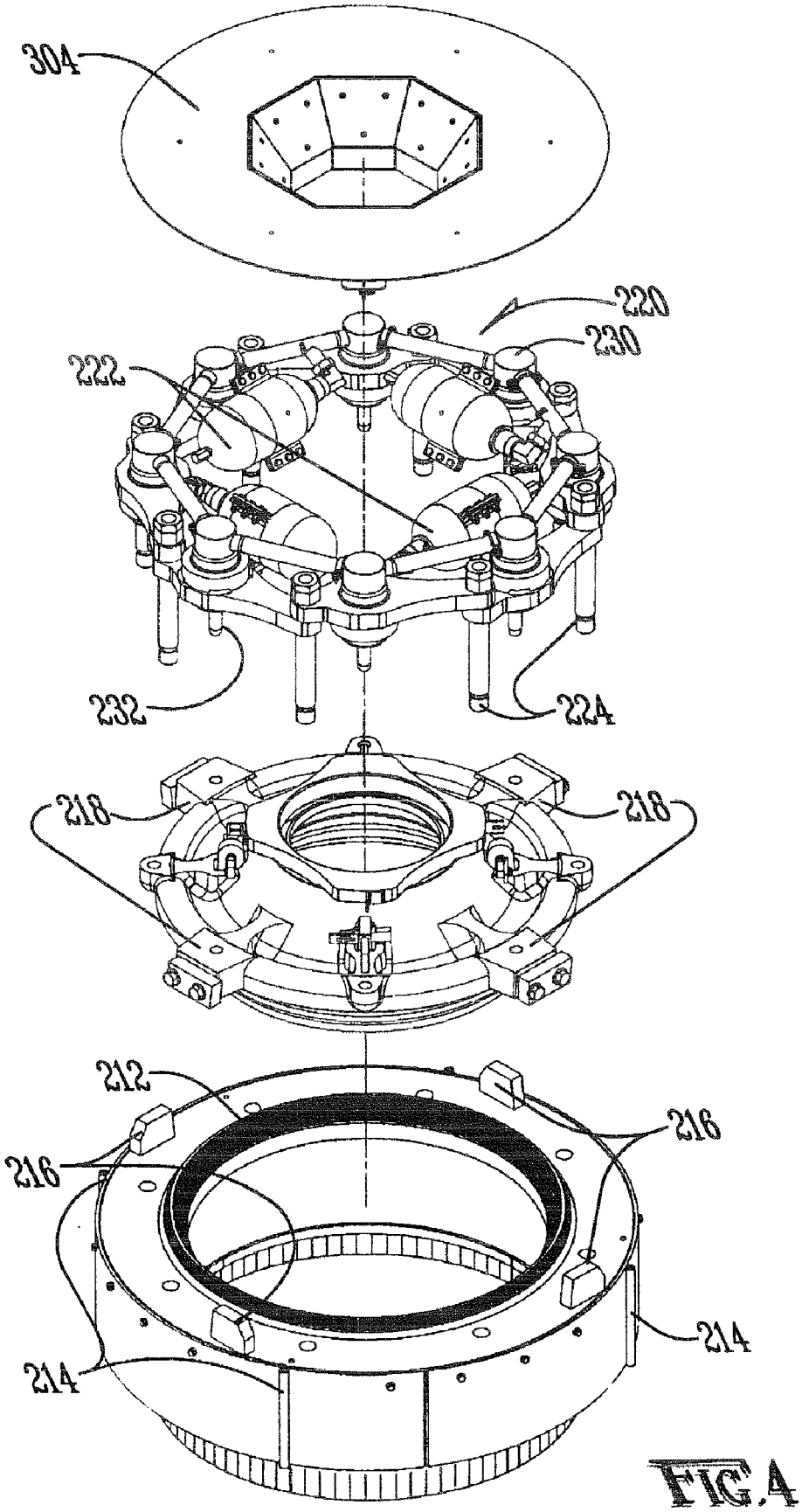
FIG. 4 is an exploded diagram of the top sections of the cone crusher of FIG. 1.
Figure 5:
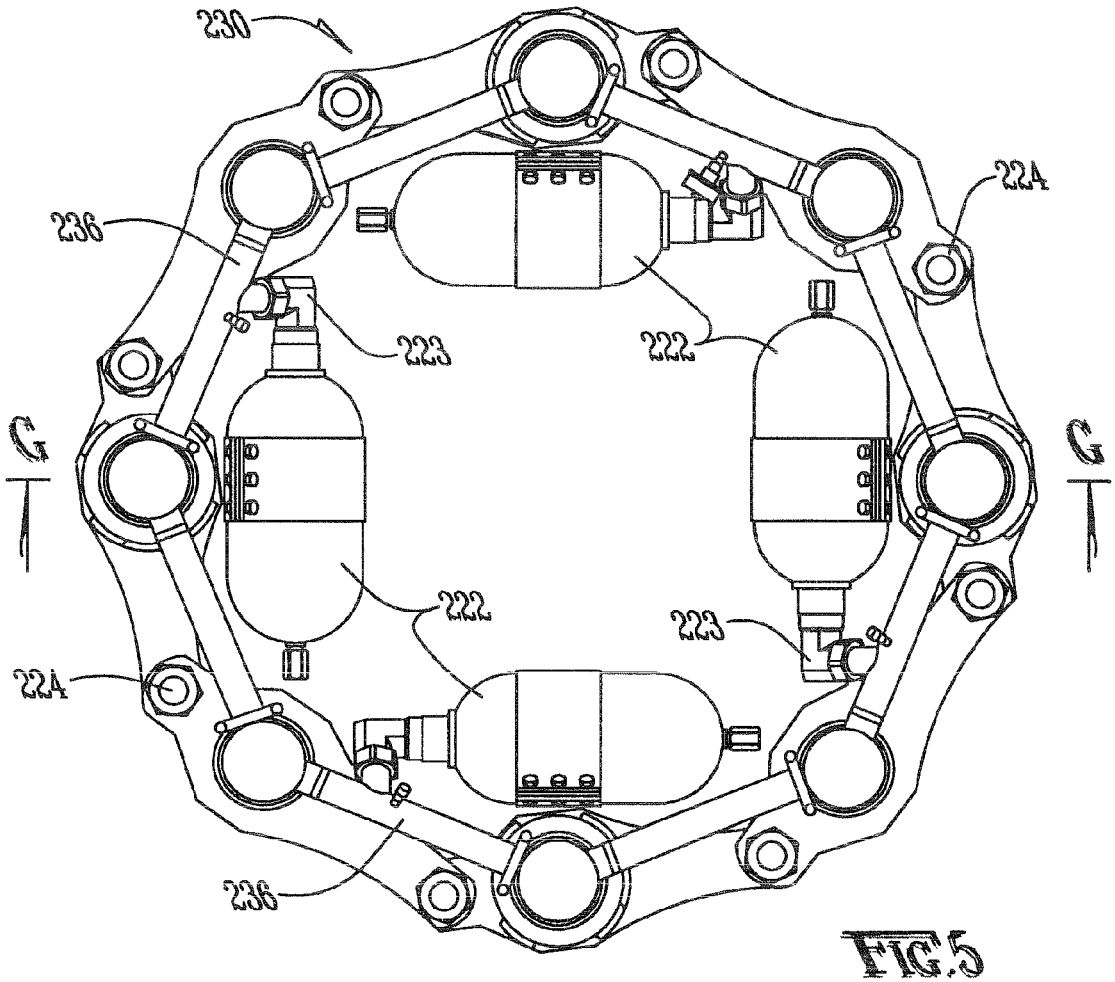
FIG. 5 is a top view of the tramp iron relief section of the cone crusher of FIG. 1.

Now referring to FIGS. 1, 2 and 3, lower section 100 is similar in many respects to prior art cone crushers and includes gyrating cone 102 which is driven by drive shaft 104. Lower section 100 has a lower section bottom 106 section and a lower section top 108.

Lower section 100 has a novel screw adjust mechanism which includes lower section internal threads 114 located at the lower section top 108. Lower section internal threads 114 are included for mating with bonnet support external threads 206. Lower section 100 further includes a clamping ring 110 which performs the function of locking the material output size setting and reducing vibration. Clamping ring 110 includes a threaded edge for mating with bonnet support external threads 206. Hydraulic locking cylinders 112 extend up through the lower section top 108 and impacts clamping ring 110 and cause it to press against bonnet support external threads 206, thereby jamming or locking the two threaded pieces together and thereby locking the material output size setting. Anti-rotation pins 113 index the clamping ring 110 with the internal thread 114, prevent rotation of clamping ring 110, but allow vertical movement of said ring for clamping action.

Bonnet 202 rests upon bonnet support 210 and specifically rests upon v seat 212. During a tramp iron event, bonnet 202 is pushed upward and pivots on one side of v seat 212 and allows any uncrushable matter to drop into the crushed output material.

To control the upward movement of the bonnet 202 during tramp iron events, bonnet 202 has bonnet rotation stops 218. Bonnet rotation stops 218 are adjacent an angled bonnet rotation stops 216 which is fixed to the top of the bonnet support 210 and tends to cause the bonnet 202 to fall back into its original position after a tramp iron event. Also bonnet 202 is contacted by tramp iron relief cylinder push rod 232, which is a component of the tramp iron relief cylinder 230 of the tramp iron relief system 220. Each tramp iron relief cylinder 230, with its internal cavity 234, is coupled to every other tramp iron relief cylinder 230 via a ring of manifold tubes 236. Also coupled to the ring of manifold tubes 236 are the accumulators 222 which are connected via accumulator fluid connector tube 223. Accumulator 222 may have a nitrogen or other gas-filled bladder therein which could be filled and pressurized to variable settings, depending upon the needs of a particular job. Accumulator 222 could have an independent valve for control of such pressure. Similarly, manifold tubes 236 and tramp iron relief cylinders 230 are filled with hydraulic fluid and can be pressurized to set standards which may vary, depending upon the particular task at hand.

The operation of the tramp iron relief system 220, shown in more detail in FIGS. 4-8, is similar to prior art tramp iron relief systems. The primary distinction of the tramp iron relief system 220 of the present invention is that it is disposed above the bonnet 202 and does not have accumulators which make the crusher overall wider; i.e., the accumulators 222 are all located inside a vertical line drawn up from the widest point of the screw adjust cone crusher with overhead tramp iron release system 1000 and are located below a point of material input into the hopper sides 304 and the optional wire basket at the hopper end 302.

Figure 9:
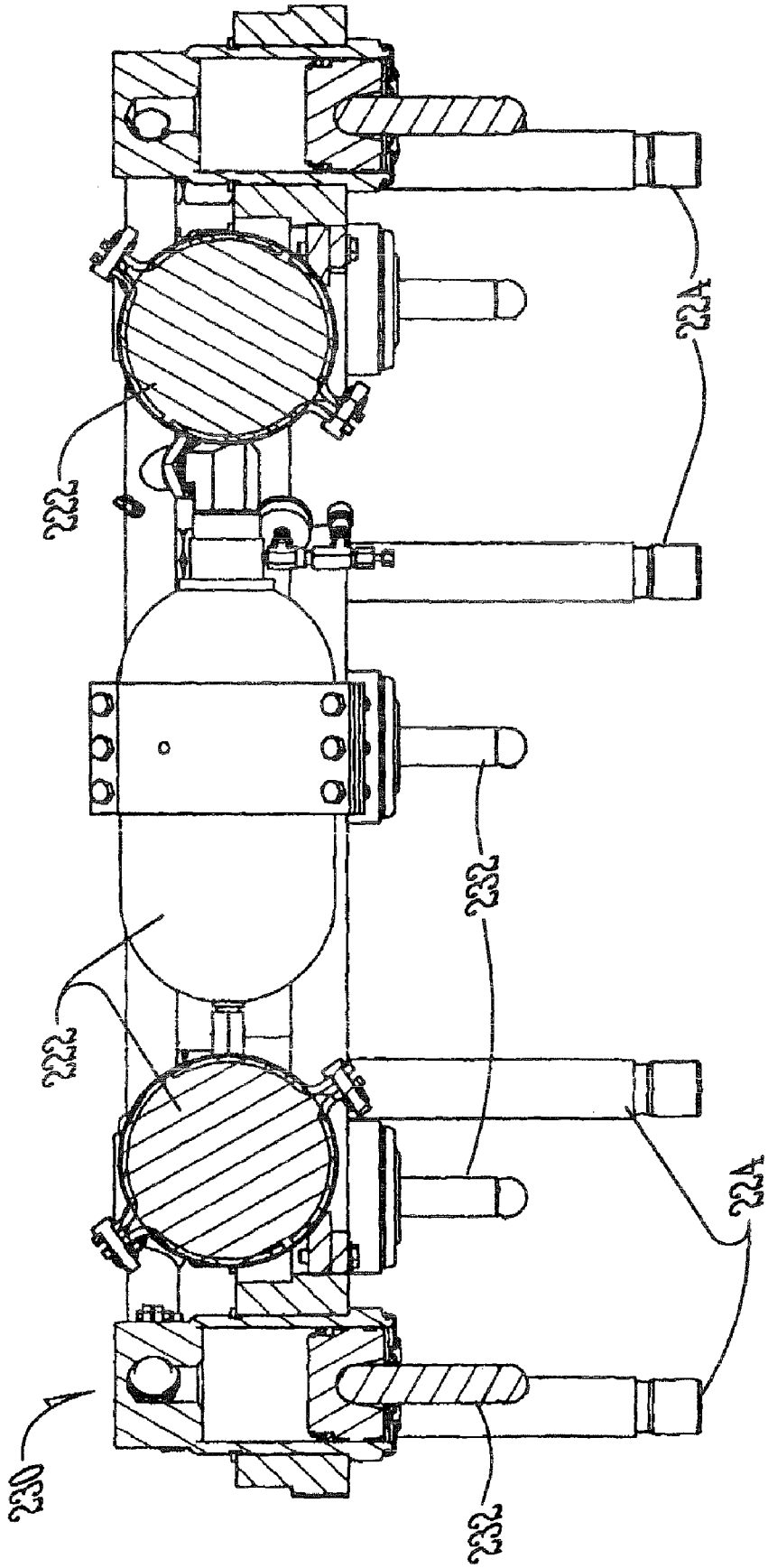
FIG. 9 is a perspective view of the bottom section of the cone crusher of FIG. 1 where the cone 102 is removed to reveal the detail of the internal threading therein configured to receive the external threading on the bottom of the bonnet support.
Figure 4:
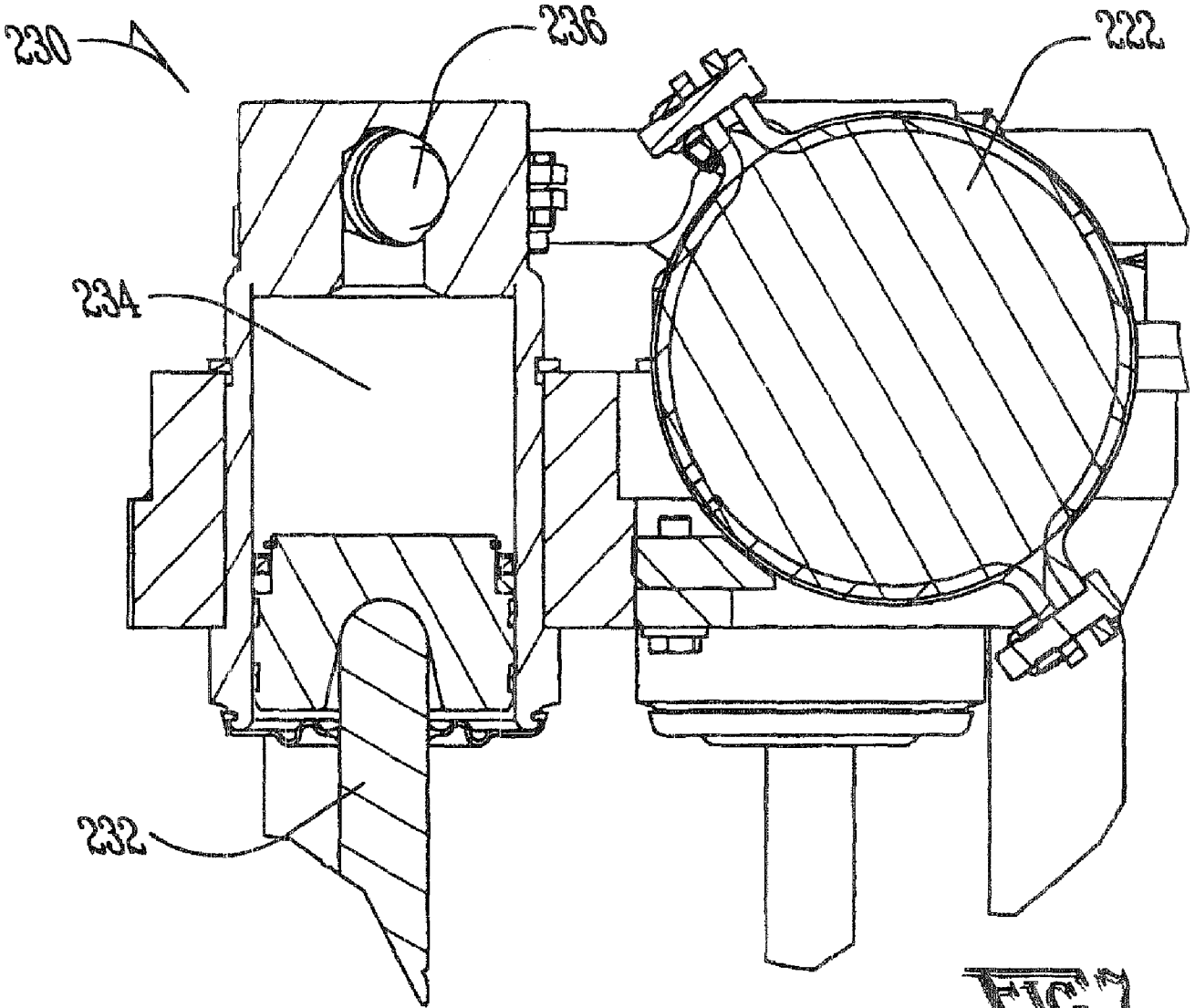
Figure 8:
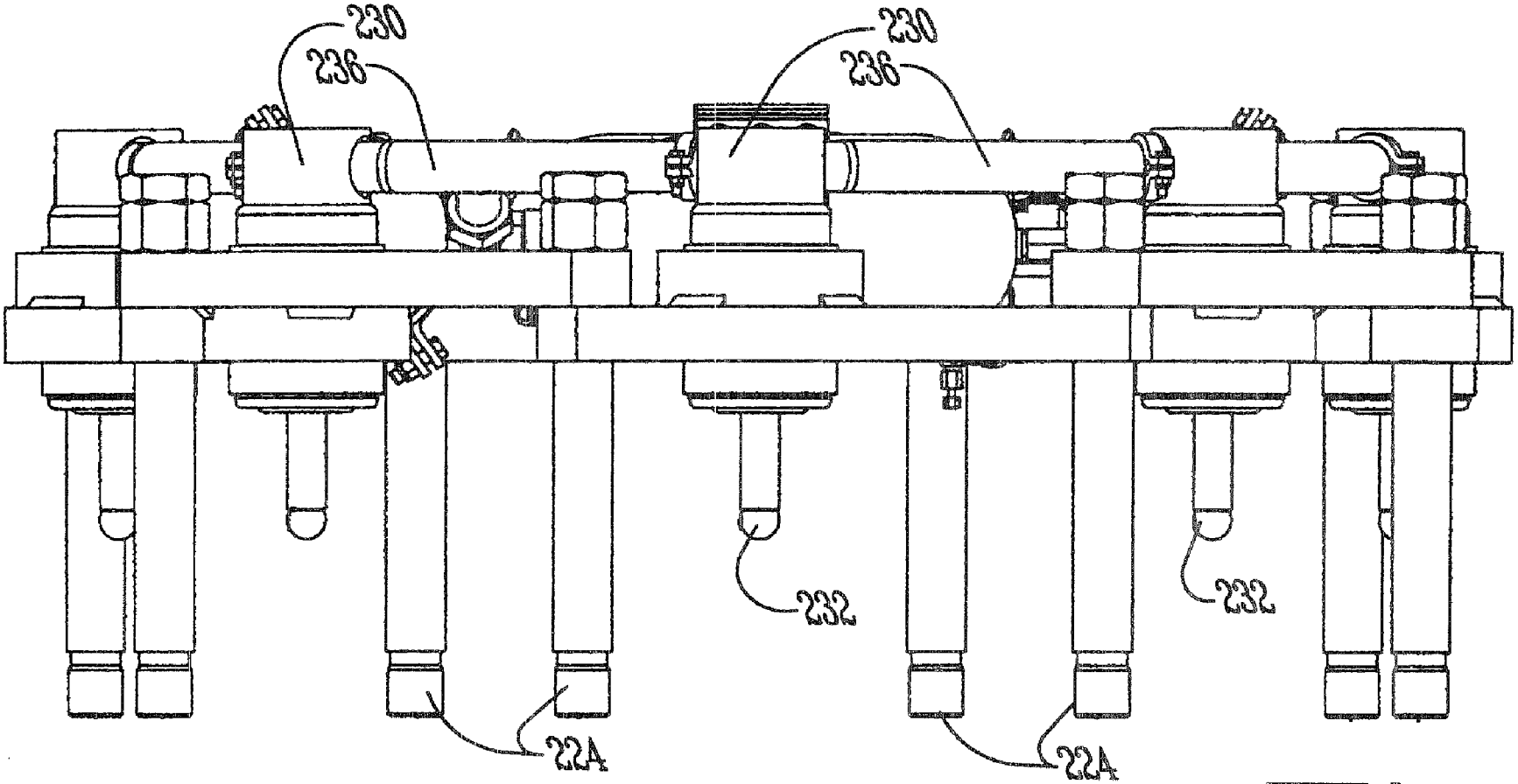
FIG. 8 is a side view of the tramp iron relief system of FIG. 5.
Figure 9:
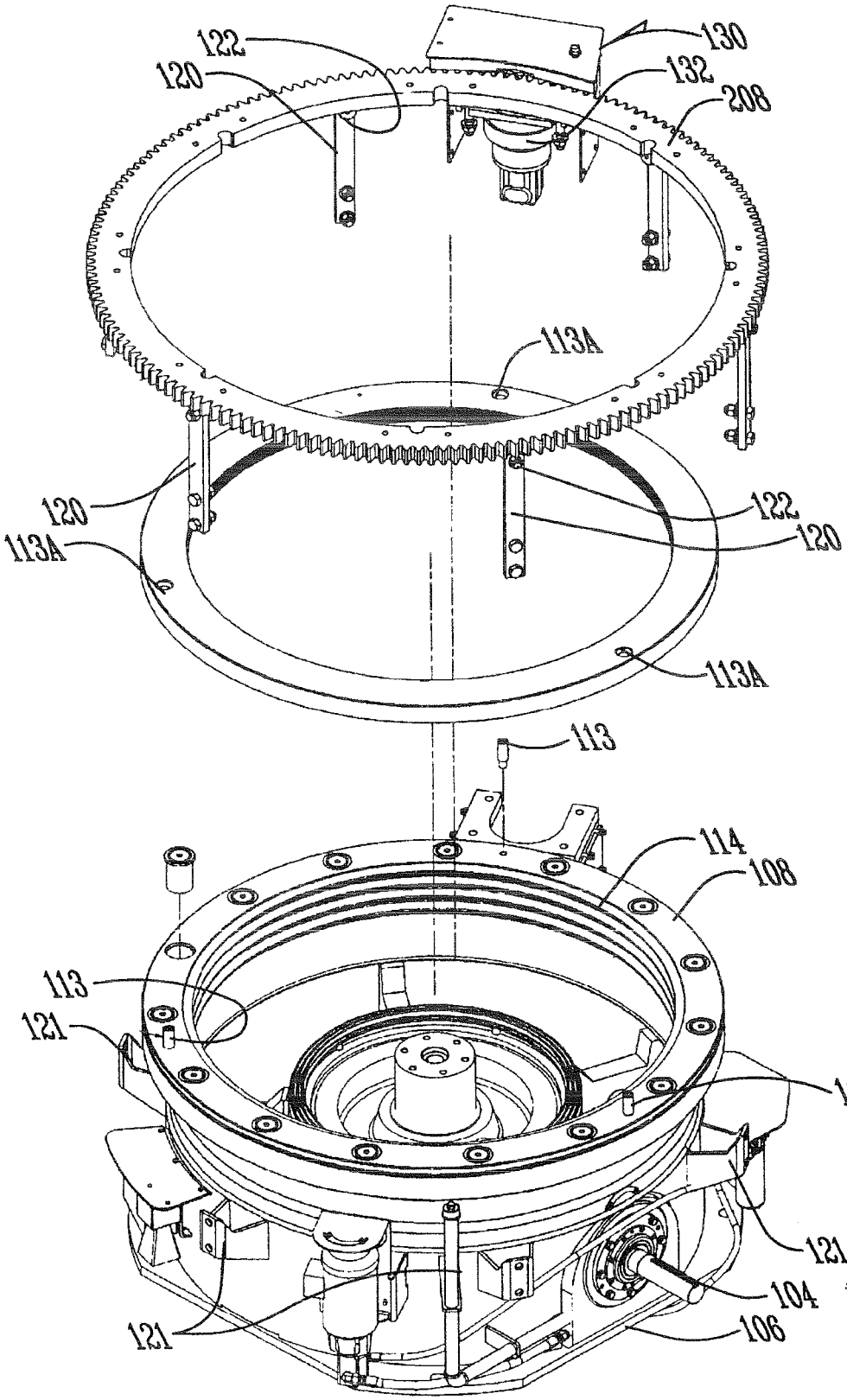

Now referring to FIGS. 1, 3 and 9, the screw adjust cone crusher with overhead tramp iron release system 1000 of the present invention can adjust its material output size setting as follows:

The clamping ring 110 is disengaged by releasing pressure on the hydraulic locking cylinders 112; this then allows the lower section internal threads 114 and the bonnet support external threads 206 to move with respect to each other. The ring gear drive mechanism 130 is energized by the ring gear drive motor 132, which drives a gear (not shown) which drives ring gear 208 to rotate. Ring gear 208 rests upon support rollers 122, ring gear supports 120 and support brackets 121. Coupled to the top of ring gear 208 are vertical channel members 140. These may be bolted on channel members with a predetermined channel gap or a non-channel vertical member could be used as well. Vertical channel members 140 are sized and configured to engage channel mating rods 214, which are attached to the bonnet support side wall 204. Channel mating rods 214 and vertical channel members 140 are both elongated members which would allow relative vertical movement while a rotational pressure is being applied; i.e., as the vertical channel members 140 push the channel mating rods 214 around, the bonnet support 210 will be threaded up or down with respect to the lower section internal threads 114, thereby raising or lowering the bonnet. The vertical channel members 140 and channel mating rods 214 combination allows for continued rotational force transmission despite significant vertical translation. Once the desired material output size setting is achieved, the ring gear drive motor 132 will be stopped and the hydraulic locking cylinders 112 will be activated to jam the clamping ring 110 into the bonnet support external threads 206, and thereby lock the material output size setting at its new setting. Note that the anti-rotation pins 113 extend through the anti-rotation pin holes 113A in clamping ring 110, to further prevent unwanted rotation.

Throughout this description the bonnet support has been described as having external threads and the lower section has been described as having internal threads. The present invention is intended to include means for screw adjusting the cone crusher which include a bonnet with internal threads and the lower section with some portion with external threads. The details of a design which is reversed from what is shown in the figures is not necessary as they would be well within ordinary skill in the art after reading the text of this specification.

It is thought that the method and apparatus of the present invention will be understood from the foregoing description and that it will be apparent that various changes may be made in the form, construct steps, and arrangement of the parts and steps thereof, without departing from the spirit and scope of the invention or sacrificing all of their material advantages. This includes using an external thread on the lower assembly 100 and an internal thread on the upper assembly. The form herein described is merely a preferred exemplary embodiment thereof.

I claim:

1. A system for crushing rock comprising:
- a lower section generally comprising a container with a top side opening with internal threads disposed inside a circumference of the top side opening;
- a gyrating cone coupled to said lower section;
- an upper section comprising:
  - a bonnet support comprising external threads configured to mate with said internal threads;
  - a bonnet disposed on said bonnet support, said bonnet configured to resist movement of rock caused by collision of rock with said gyrating cone;
- a tramp iron relief system comprising:
  - a plurality of accumulators disposed above said bonnet.

2. The cone crusher of claim 1 wherein said plurality of accumulators are disposed entirely above said internal threads.

3. The cone crusher of claim 2 wherein said plurality of accumulators are disposed entirely above said bonnet support.

4. The cone crusher of claim 3 wherein said plurality of accumulators are disposed entirely above said bonnet.

5. The cone crusher of claim 1 further comprising:
- a motor driven drive gear configured to rotate around an axis fixed with respect to said lower section;
- a ring gear configured to mesh with and be driven by said motor driven drive gear, said ring gear disposed around an external periphery of said bonnet support;
- said ring gear being configured to impart a rotational force and movement upon said bonnet support when said ring gear is caused to rotate by said motor driven drive gear; said ring gear further configured to allow said bonnet support to translate vertically, so as to permit said bonnet support to rotate and move up and down, with respect to said gyrating cone, during adjustment of a material output size setting.

6. The cone crusher of claim 5 wherein said ring gear and bonnet support further comprise a plurality of channel members substantially perpendicular with respect to a horizontal plane of said ring gear and coupled with one of said ring gear and said bonnet support and further comprising a plurality of longitudinal protuberances coupled with one of said ring gear and an exterior surface of said bonnet support, wherein each of said plurality of longitudinal protuberances are configured to fit within at least one of said plurality of channel members, so that said bonnet support is allowed to translate up and down with respect to said ring gear.

7. A cone crusher of claim 6 further comprising a plurality of roller supports disposed around a periphery of said lower section and configured to support from beneath said ring gear and further configured to permit said ring gear to rotate on said roller supports.

8. A cone crusher of claim 7 further comprising a threaded ring disposed adjacent said internal threads and configured to lock said bonnet support in a position by hydraulically causing said thread ring to be jammed against the external threads.

9. A cone crusher comprising:

a gyrating cone;

means for supporting the gyrating cone;

a bonnet;

means for supporting said bonnet, such that rotation of an external ring gear rotationally coupled with said bonnet results in rotation and up and down movement of the bonnet, depending on a direction of rotation of the ring gear; and, means disposed substantially entirely above the bonnet, for releasing tramp iron from under the bonnet.

10. The cone crusher of claim 9 wherein said external ring gear is disposed below said bonnet.

11. The cone crusher of claim 9 further comprising a means for selectively preventing rotation of said means for supporting.

12. The cone crusher of claim 11 wherein said means for selectively preventing rotation comprises a hydraulically actuated clamp ring coupled to said means for supporting the gyrating cone.

13. The cone crusher of claim 9 wherein said means for supporting said bonnet comprises a bonnet support with external threads which mate with internal threads on a lower section of said cone crusher;

wherein said means for supporting said bonnet comprises a bonnet support with external threads which mate with internal threads on a lower section of said cone crusher; and further comprising means for rotating said external ring gear so as to adjust a material output size setting.

14. A cone crusher comprising:

a gyrating cone;

a bonnet, disposed above said gyrating cone;

means for maintaining an adjustable vertical separation distance between said bonnet and said gyrating cone, where adjustment of the adjustable vertical separation distance is achieved by rotating two threaded objects with respect to each other in one direction to achieve an increased adjustable vertical separation distance and in an opposing direction to achieve a decreased adjustable vertical separation distance; and means, disposed substantially entirely above the bonnet, for releasing tramp iron from under the bonnet.

15. A cone crusher of claim 14 wherein said means for maintaining comprises a bonnet support with a threaded exterior and a base structure with a threaded interior.

16. The cone crusher of claim 14 wherein said means, disposed substantially entirely above the bonnet, for releasing tramp iron comprises a plurality of accumulators, each of which is disposed entirely above said bonnet and around a periphery of a hopper configured to feed material to be crushed from above downwardly into an opening in the top of the bonnet.

* * * * *